US006483022B1

(12) United States Patent
Packard

(10) Patent No.: US 6,483,022 B1
(45) Date of Patent: Nov. 19, 2002

(54) METHODS AND APPARATUS FOR IGNITION LEAD ASSEMBLY CONNECTIONS

(75) Inventor: Edward Alan Packard, Cleves, OH (US)

(73) Assignee: General Electric Company, Schenectady, NY (US)

( * ) Notice: Subject to any disclaimer, the term of this patent is extended or adjusted under 35 U.S.C. 154(b) by 49 days.

(21) Appl. No.: 09/672,183

(22) Filed: Sep. 28, 2000

(51) Int. Cl.[7] ..... H01B 9/06; H01R 4/00
(52) U.S. Cl. ..... 174/15.1; 174/84 R
(58) Field of Search ..... 174/15.1, 35 C, 174/74 R, 79, 75 F, 84 R, 92

(56) References Cited

U.S. PATENT DOCUMENTS

| | | | | |
|---|---|---|---|---|
| 3,924,403 A | * | 12/1975 | Irwin | 60/39.32 |
| 4,003,672 A | * | 1/1977 | Gamell | 415/71 |
| 4,621,881 A | * | 11/1986 | Johansson et al. | 339/26 |
| 5,050,384 A | * | 9/1991 | Crockett | 60/605.1 |
| RE34,152 E | * | 12/1992 | Meyer | 313/126 |
| 5,283,499 A | * | 2/1994 | Adam et al. | 313/135 |
| 5,381,773 A | | 1/1995 | Straub | |
| 5,396,761 A | | 3/1995 | Woltmann et al. | |
| 5,402,637 A | * | 4/1995 | Adam | 60/39.827 |
| 5,467,758 A | | 11/1995 | Moriyama et al. | |
| 6,232,703 B1 | | 5/2001 | Huffman | |

FOREIGN PATENT DOCUMENTS

| | | | | |
|---|---|---|---|---|
| GB | 2 080 010 A | * | 1/1982 | H01B/7/00 |

* cited by examiner

*Primary Examiner*—Anthony Dinkins
*Assistant Examiner*—William H. Mayo, III
(74) *Attorney, Agent, or Firm*—Nathan D. Herkamp; Armstrong Teasdale LLP

(57) ABSTRACT

An ignition lead assembly that includes a seal sub-assembly that permits the ignition lead assembly to be pressurized, thus facilitating a reduction in the formation of corona within the ignition lead assembly. The ignition lead assembly also includes an ignition cable housed within a conduit and attached at each end to a connector. The ignition cable also includes a plurality of wires encased within permeable electrical insulation. The conduit also includes an air-cooled portion and a non-air-cooled portion connected together with a coupling assembly. The seal sub-assembly prevents air pressure from decreasing within the pressurized ignition lead assembly.

19 Claims, 3 Drawing Sheets

METHODS AND APPARATUS FOR IGNITION LEAD ASSEMBLY CONNECTIONS

BACKGROUND OF THE INVENTION

This invention relates generally to ignition lead assemblies and, more particularly, to methods and apparatus for connecting ignition lead assemblies within gas turbine engines.

Gas turbine engines typically include ignition systems to provide ignition to a fuel and air mixture within the gas turbine engine. The gas turbine engine ignition systems include lead assemblies connected to engine exciters and engine igniters. Specifically, the lead assembly connectors are connected to an igniter cable housed within a flexible conduit. The igniter cable includes a stranded center conductor encased within electrical insulation which is permeable to varying degrees. Each connector housing contains terminal dielectrics sealed with silicone grommets. The connectors are sealed so that air trapped in each connector has a pressure equal to that of atmospheric pressure.

In use, and at altitude, because the engine lead assembly connectors are not hermetically sealed, the air initially trapped within the sealed connectors slowly escapes from the connectors through the permeable ignition cable electrical insulation. At ground-level, air slowly seeps into the connectors through the ignition cable electrical insulation. Because air seeps into the connectors at approximately the same rate as air escapes from the connectors, the connectors on engines that operate more frequently or for longer durations at altitude are subjected to lower average air pressures in comparison to connectors on engines that operate less frequently or for shorter durations at altitude.

Operating the ignition system with reduced air pressure in the sealed ignition lead to engine exciter connection and the sealed ignition lead to engine igniter connection may cause partial electrical discharges, known as corona. Over time, continued exposure to corona may lead to damage of terminal dielectrics housed within the connectors. To minimize the effects of corona, at least some known engine ignition systems include molding or corona suppressants to reduce the amount of air trapped within the ignition system. Such molding or corona suppressants may be expensive, add complexity to the ignition system, and are difficult to inspect for conformance to quality requirements. Other ignition systems include connectors using various configurations and surface shapes to increase the ignition system's tolerance of corona, and often eliminate sharp edges on sub-components of the connectors to reduce a strength of local electric fields which can lead to corona.

BRIEF SUMMARY OF THE INVENTION

In an exemplary embodiment, an ignition lead assembly includes a seal sub-assembly that prevents contamination from entering the ignition lead assembly and prevents complete depressurization of the ignition lead assembly, thus facilitating a reduction in the formation of corona within ignition lead assembly connectors. In a second embodiment, the seal assembly permits the ignition lead assembly to be pressurized to facilitate a reduction in the formation of corona within ignition lead assembly connectors. The ignition lead assembly includes an ignition cable housed within a conduit and attached at each end to connectors. The ignition cable includes a plurality of wires encased within permeable electrical insulation. The conduit includes an air-cooled portion and a non-air-cooled portion connected together with a coupling assembly. The seal sub-assembly includes a housing, a seal, a retainer, and a biasing mechanism, and prevents a loss of air pressure from the non-air-cooled portion of the ignition lead assembly.

In use, cooling air is channeled into the conduit air-cooled portion at a pressure only slightly above that of engine core cavity ambient air pressure, thus creating a negative pressure differential between the inside and outside of the ignition cable, causing air to escape radially outward from the inside of the ignition cable through the permeable electrical insulation.

The seal sub-assembly traps air in the conduit non-air-cooled portion of the lead assembly preventing a loss of air pressure. In the second embodiment, an external air source simultaneously directs pressurized airflow into the non-air-cooled portion of the lead assembly. In both embodiments, a pressure differential between the inside and outside of the ignition cable within the non-air-cooled portion is positive causing air to seep into the ignition cable inside through the ignition cable electrical insulation. Because the pressure differential across the ignition cable within the conduit non-air-cooled portion is greater than the pressure differential across the ignition cable within the conduit air-cooled portion, a pressure balance occurs across the ignition cable and air trapped within the connectors is pressurized. The pressurized air within the connectors facilitates a reduction in the formation of potentially damaging corona, thus extending a useful life of the ignition lead assembly. As a result, the ignition lead assembly facilitates reducing potentially damaging arcing within the connectors.

DETAILED DESCRIPTION OF THE INVENTION

Figure 1:
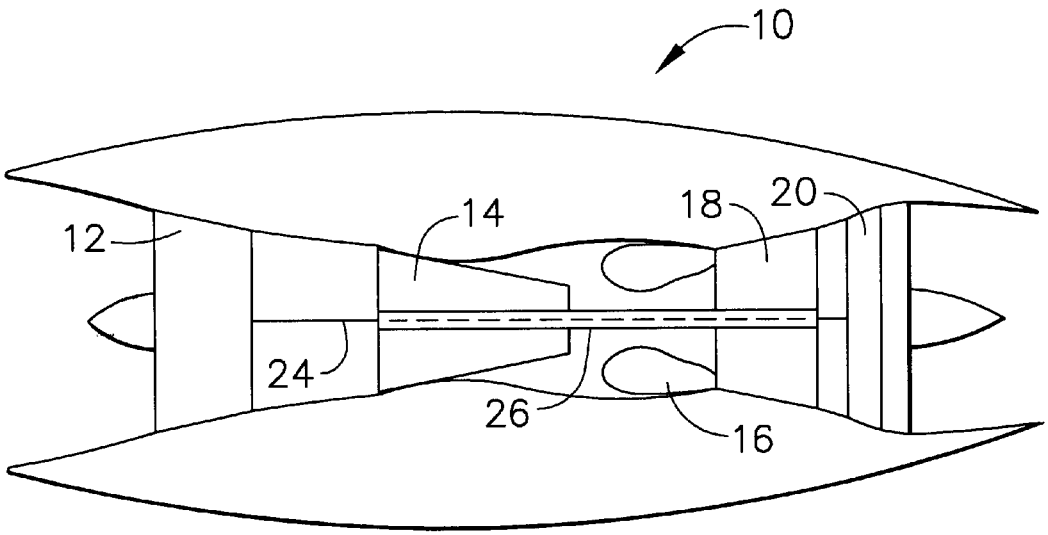
FIG. 1 is a schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18, and a low pressure turbine 20. Compressor 12 and turbine 20 are coupled by a first rotor shaft 24, and compressor 14 and turbine 18 are coupled by a second rotor shaft 26. In one embodiment, engine 10 is a CFM56 engine available from General Electric Aircraft Engines, Cincinnati, Ohio.

In operation, air flows through low pressure compressor 12 and compressed air is supplied from low pressure compressor 12 to high pressure compressor 14. Compressed air is then delivered to combustor 16 and airflow from combustor 16 drives turbines 18 and 20.

Figure 3:
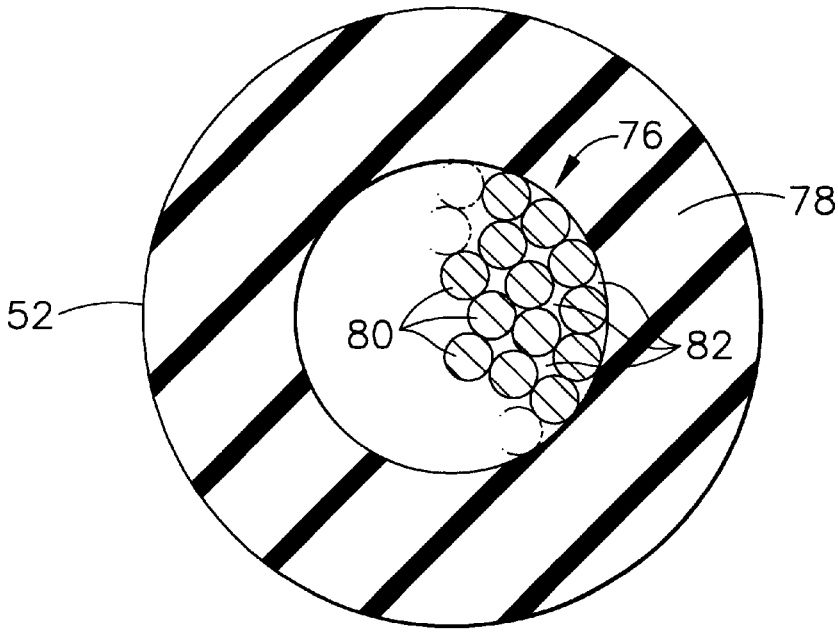
FIG. 3 is a cross-sectional view of the ignition cable shown in FIG. 1 taken along line 3—3.
Figure 2A:
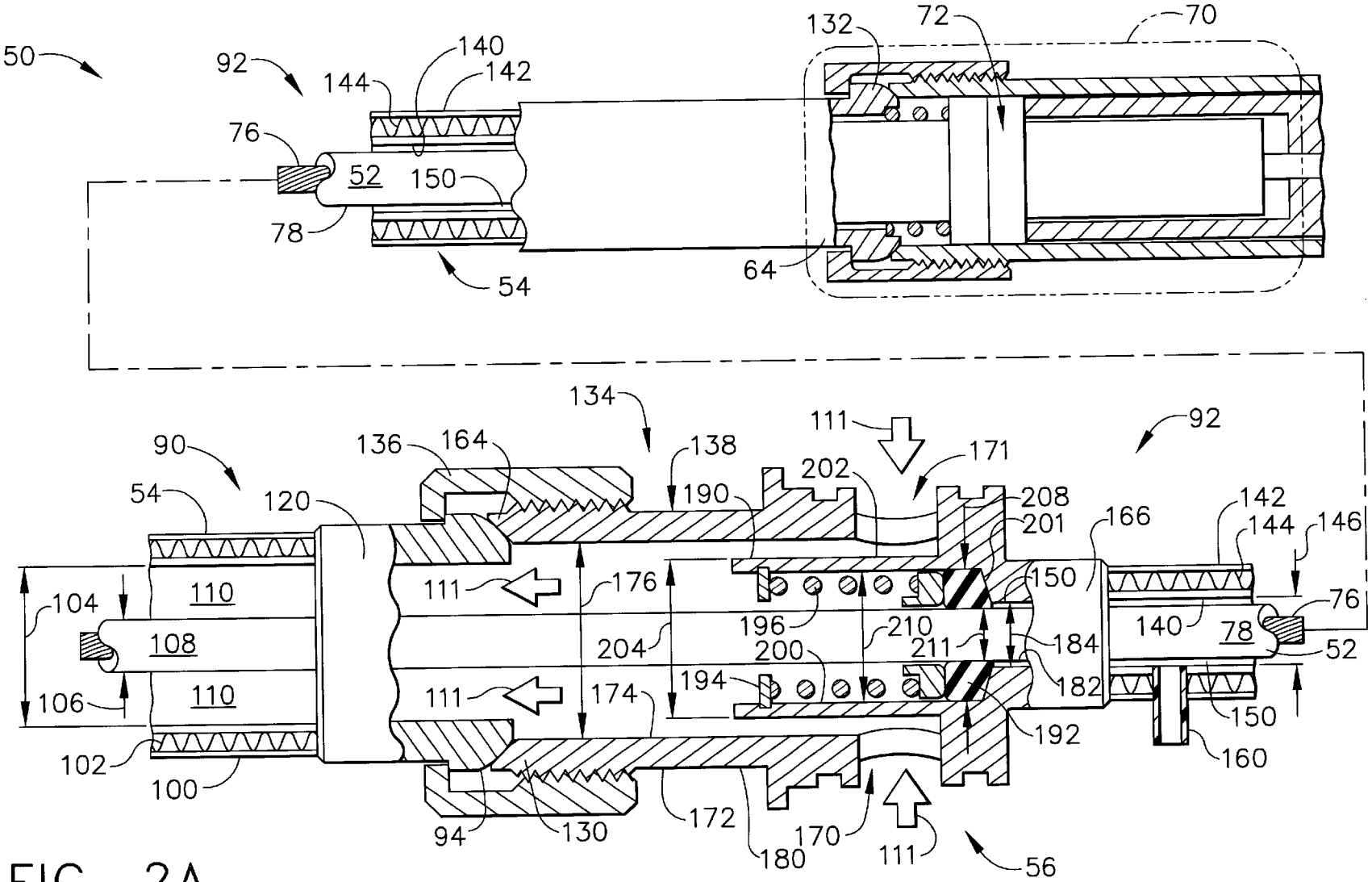
FIG. 2A is a side cross-sectional view of a pressurized ignition lead assembly including an ignition cable.
Figure 2B:
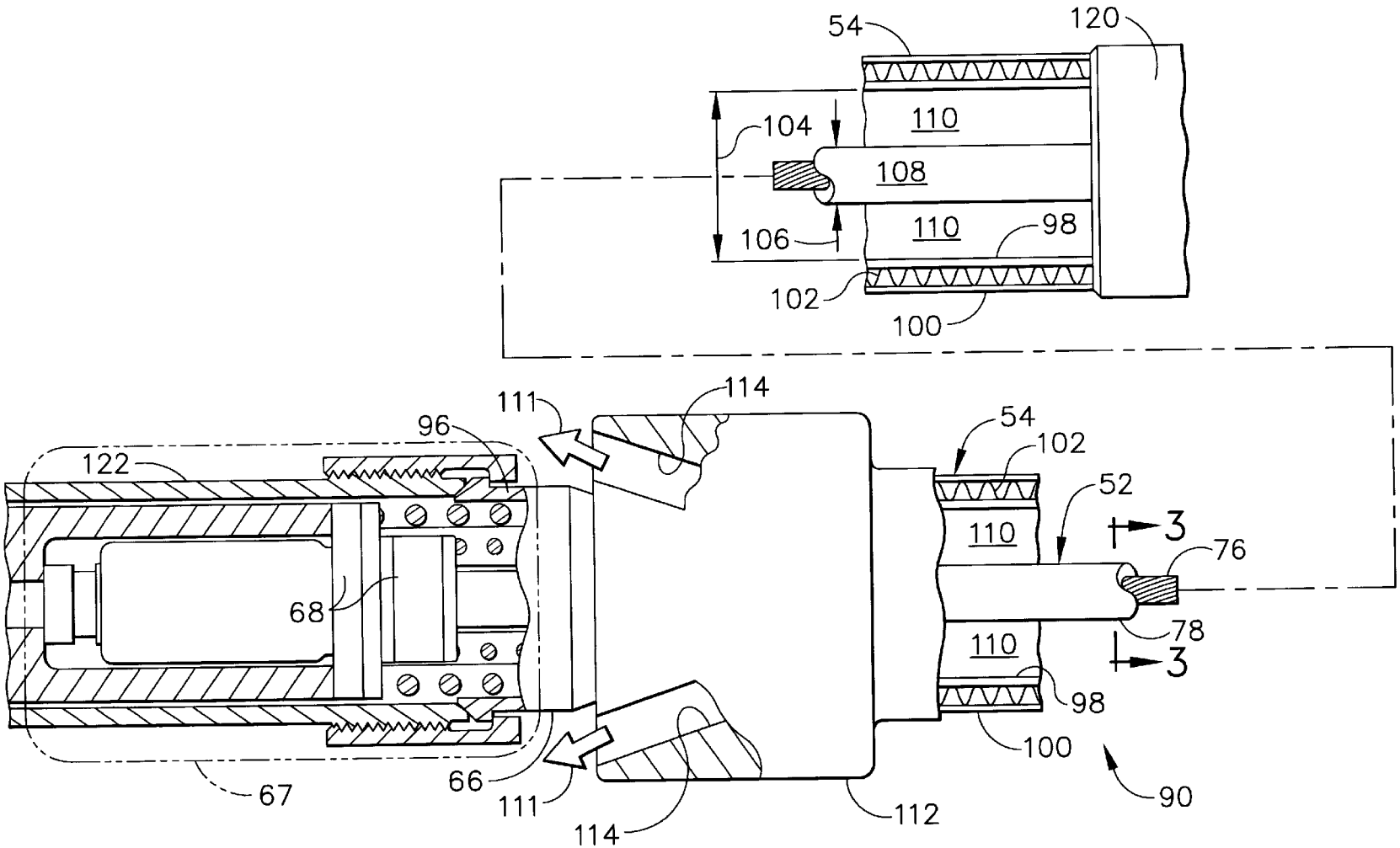
FIG. 2B is a continuation of FIG. 2A.

FIGS. 2A and 2B are a side cross-sectional view of a pressurized ignition lead assembly 50 including an ignition cable 52, a conduit 54, and a seal sub-assembly 56. FIG. 3 is a cross sectional view of ignition cable 52 taken along line 3—3. Conduit 54 extends between an ignition lead assembly first end, or non-air-cooled end, 64 and an ignition lead assembly second end, or air-cooled end, 66.

Ignition lead assembly second end 66 is coupled to an engine igniter (not shown) with a connector 67. In the exemplary embodiments, connector 67 is a Society of Automotive Engineers (SAE)/Aerospace Recommended Practice (ARP) 670, Type-4 terminal that includes a plurality of elastomeric silicone grommets 68 that prevent electrical arcing within connector 67, and also prevent air trapped within connector 67 from decreasing in pressure.

Ignition lead assembly first end 64 is coupled to an engine exciter (not shown) with a connector 70. In the exemplary embodiments, connector 70 is an SAE/ARP 670, Type-3 terminal that includes an insulator 72 that contains a plurality of seals (not shown) to prevent electrical arcing within connector 70 and also prevent air trapped within connector 70 from decreasing in pressure.

Ignition cable 52 extends between ignition lead assembly first and second ends 64 and 66, respectively, within conduit 54. Cable 52 includes a center conductor 76 housed within an electrical insulation 78. Electrical insulation 78 prevents conductor 76 from being inadvertently contacted, and is fabricated from an insulating material that is permeable. In one embodiment, insulation 78 is fabricated from an extruded silicone material.

Cable center conductor 76 includes a plurality of individual wires 80. Wires 80 are arranged in a compact pattern such that a plurality of voids 82 are defined between adjacent wires 80. Voids 82 extend along ignition cable 52 between first and second ends 64 and 66, respectively.

Conduit 54 is flexible and includes an air-cooled portion 90 and a non-air-cooled portion 92. Air-cooled portion 90 extends from non-air-cooled portion 92 to ignition lead assembly connector 67. More specifically, air-cooled portion 90 extends from a first end 94 to a second end 96 adjacent ignition lead assembly connector 67. A length (not shown) of conduit air-cooled portion 90 is less than a length (not shown) of conduit non-air-cooled portion 92. Conduit air-cooled portion 90 includes an inner surface 98 and an outer surface 100 separated with a layer of flexible convoluted metal conduit 102. Air-cooled portion inner surface 98 defines an inner diameter 104 that is larger than an outer diameter 106 of ignition cable 52 defined by an outer surface 108 of ignition cable electrical insulation 78. Because conduit air-cooled portion inner diameter 104 is larger than ignition cable outer diameter 106, an air gap 110 is defined between ignition cable 52 and conduit air-cooled portion 90.

Air gap 110 provides a channel for cooling air 111 to flow for cooling ignition lead assembly 50. Air gap 110 is annular and extends circumferentially around ignition cable 52 from conduit non-air-cooled portion 92 to a boss 112 installed adjacent ignition lead assembly connector 67. Boss 112 couples to conduit air-cooled portion second end 96 adjacent igniter connector 67. Boss 112 is annular and includes an array of openings 114. Boss openings 114 are in flow communication with air gap 110 and provides an exhaust outlet, such that cooling air 111 flowing through air gap 110 is directed outwardly from ignition lead assembly 50 to atmosphere. Cooling air 111 entering air gap 110 enters through a tapered connector sleeve 120 attached to conduit air-cooled portion first end 94, and cooling air 111 exits air gap 110 to cool an exterior surface 122 of igniter connector 67.

Non-air-cooled portion 92 extends between a first end 130 and a second end 132 adjacent ignition lead assembly connector 70. Non-air-cooled portion 92 is integrally formed with a coupling assembly 134 at non-air-cooled first end 130. Coupling assembly 134 is used to connect non-air-cooled portion 92 to air-cooled portion 90, and includes a coupling nut 136 and a housing 138. Coupling nut 136 interlocks with conduit tapered connector sleeve 120 to secure conduit non-air-cooled portion 92 with conduit air-cooled portion 90, such that tapered connector sleeve 120 is in contact with coupling assembly housing 138.

Conduit non-air-cooled portion 92 includes an inner surface 140 and an outer surface 142 separated with a layer of flexible convoluted metal conduit 144. Non-air-cooled portion inner surface 140 defines an inner diameter 146 that is larger than ignition cable outer diameter 106. Because conduit non-air-cooled portion inner diameter 104 is larger than ignition cable outer diameter 106, an air gap 150 is defined between ignition cable 52 and conduit non-air-cooled portion 92.

Air gap 150 extends between coupling assembly 134 and conduit non-air-cooled portion second end 132. In a second embodiment, air gap 150 is in flow communication with a pressure port 160 extending from conduit non-air-cooled portion 92. More specifically, pressure port 160 extends substantially perpendicularly from conduit non-air-cooled portion outer surface 142 and is coupled to an air source (not shown) extending from engine 10 (shown in FIG. 1) to receive pressurized air (not shown) into air gap 150. Pressure port 160 is in close proximity to conduit non-air-cooled portion first end 130 and coupling assembly 134. In an alternative embodiment, pressure port 160 is located along non-air-cooled portion 92 of ignition lead assembly 50 between coupling assembly 134 and connector 70.

Coupling assembly housing 138 is substantially cylindrical and includes a first end 164 and a second end 166. First end 164 is tapered, such that when coupling nut 136 is interlocked with air-cooled portion connector sleeve 120 to secure non-air-cooled portion 92 to air-cooled portion 90, coupling assembly housing 138 contacts air-cooled portion connector sleeve 120 to create a substantially air-tight seal.

A passageway 170 is comprised of a plurality of openings 171 and extends radially inward through coupling assembly housing 138 in close proximity to coupling housing second end 166. Passageway 170 extends from an outer surface 172 of coupling assembly housing 138 to an inner surface 174 of coupling assembly housing 138. Coupling assembly inner surface 174 defines an inner diameter 176 that is larger than ignition cable outer diameter 106, such that passageway 170 is in flow communication with conduit air-cooled portion air gap 110. A cooling air source (not shown) from engine 10 is coupled to passageway 170 and supplies cooling air 111 to ignition lead assembly 50, and more specifically into ignition lead assembly air gap 110.

Coupling housing 138 includes an irregular annular outer surface 180 that couples housing 138 to engine 10. Coupling assembly housing second end 166 and has an inner surface 182 that defines an inner diameter 184. Housing second end diameter 184 is larger than ignition cable outer diameter 106 and smaller than coupling housing inner diameter 176, such that non-air-cooled portion air gap 150 extends from non-air-cooled portion 92 through coupling assembly housing second end 166 to seal sub-assembly 56.

Seal sub-assembly 56 is housed within coupling housing 138 and extends concentrically with respect to coupling housing 138 from housing second end 166 towards conduit air-cooled portion 90. In an alternative embodiment, seal assembly 56 is located and housed in conduit non-air-cooled portion 92, in close proximity to housing second end 166. Seal sub-assembly 56 includes a housing 190, a seal member 192, a retainer 194, and a biasing mechanism 196. Seal sub-assembly housing 190 is substantially cylindrical and is substantially concentric with respect to ignition cable 52.

Seal sub-assembly housing 190 includes inner surfaces 200 and 201, and an outer surface 202. Outer surface 202 is radially inward from coupling housing inner surface 174 and defines a diameter 204 that is smaller than coupling housing inner diameter 176. As such, coupling housing passageway 170 is in flow communication with ignition lead assembly air gap 110.

Seal member 192 is housed within seal sub-assembly housing 190 adjacent to coupling assembly inner surface 174. Seal member 192 has an outer diameter 208 that is substantially equal to an inner diameter 210 defined by seal sub-assembly housing inner surface 200, and has an inner diameter 211 that is substantially equal to ignition cable outer diameter 106. Accordingly, seal member 192 is in sealable contact with seal member housing inner surfaces 200 and 201, and ignition cable electrical insulation outer surface 108.

Seal sub-assembly biasing mechanism 196 is housed within seal sub-assembly housing 190 adjacent seal member 192. In one embodiment, seal sub-assembly biasing mechanism 196 is a spring. Biasing mechanism 196 is held in biasing contact against seal member 192 with retainer 194. In one embodiment, retainer 194 is a snap-ring retainer. Retainer 194 maintains seal sub-assembly biasing mechanism 196 in a biased or compressed state against seal member 192 such that seal member 192 is maintained in sealable contact against seal member housing surfaces 200 and 201, and ignition cable electrical insulation outer surface 108. Accordingly, seal member 192 seals against conduit non-air cooled portion air gap 150, such that air gap 150 is not in flow communication with conduit air-cooled portion air gap 110. Furthermore, in the second embodiment, seal member 192 causes conduit non-air-cooled portion air gap 150 to function as a static air plenum that can be pressurized through conduit non-air-cooled portion pressure port 160.

In use, when engine 10 is not airborne, air trapped within connectors 67 and 70 is at ground-level ambient pressure. Connectors 67 and 70 are connected with ignition cable 52, thus air trapped within ignition cable voids 82 is in flow communication with connectors 67 and 70, and is thus, also at ground-level ambient pressure.

When engine 10 is airborne, cooling air 111 enters ignition lead assembly conduit air-cooled portion 90 through coupling assembly housing passageway 170 at a pressure only slightly above that of engine core cavity ambient air pressure. Thus, a pressure differential created between ignition cable voids 82 and that portion of ignition cable outer surface 108 housed within conduit air-cooled portion 90 is negative. As a result of the negative pressure differential air flows from connectors 67 and 70 through ignition cable voids 82 radially outward through permeable electrical insulation 78.

Simultaneously, because of seal sub-assembly 56, air is trapped in conduit non-air-cooled portion air gap 150. The air is maintained at ground ambient pressure or is pressurized through conduit non-air-cooled portion pressure port 160 and a pressure differential created between ignition cable voids 82 and that portion of ignition cable outer surface 108 housed within conduit non-air-cooled portion 92 is positive. As a result of the positive pressure differential, air flows into ignition cable voids 82 through permeable ignition cable electrical insulation 78. Furthermore, a positive pressure differential across that portion of ignition cable electrical insulation 78 housed within conduit non-air-cooled portion 92 counteracts the negative pressure differential across that portion of ignition cable electrical insulation 78 housed within conduit air-cooled portion 90 and as a result, a pressure balance occurs that, depending on the embodiment, either prevents complete depressurization, or pressurizes the air trapped within connectors 67 and 70. As a result of the pressure balance, a reduction of the formation of potentially damaging corona is facilitated, and thus, a useful life of ignition lead assembly 50 is potentially extended.

The above-described ignition lead assembly is cost-effective and highly reliable. The ignition lead assembly includes a seal sub-assembly housed within a coupling that connects the conduit non-air-cooled and air-cooled portions of the conduit. The seal sub-assembly prevents the conduit non-air-cooled portion air gap from being in flow communication with the conduit air-cooled portion air gap, such that only the conduit non-air-cooled portion air gap may be pressurized. As a result, the ignition lead assembly mated connectors are pressurized which facilitates a reduction in the formation of corona within the connectors in a cost-effective and reliable manner.

While the invention has been described in terms of various specific embodiments, those skilled in the art will recognize that the invention can be practiced with modification within the spirit and scope of the claims.

What is claimed is:

1. A pressurized ignition lead assembly for an aircraft engine, said ignition lead assembly comprising:

an ignition cable;

a conduit extending circumferentially around said ignition cable and comprising an air-cooled portion and a non-air-cooled portion, said conduit further comprising an opening extending between an exterior and an interior surface of said conduit for supplying cooling air to said conduit air-cooled portion;

a seal sub-assembly between said ignition lead assembly air-cooled portion and said ignition lead assembly non-air-cooled portion, said seal sub-assembly comprising a housing and a seal therein, said seal sub-assembly configured to prevent a loss of air pressure from said pressurized ignition lead assembly; and an engine coupling attached to said ignition lead assembly non-air cooled portion for attaching said ignition cable to the gas turbine engine, said engine coupling comprising a seal configured to prevent pressure decreases of air from said engine coupling.

2. An ignition lead assembly in accordance with claim 1 wherein said seal sub-assembly further comprises a retainer and a biasing mechanism, said retainer configured to maintain said biasing mechanism within said seal sub-assembly housing.

3. An ignition lead assembly in accordance with claim 2 wherein said seal sub-assembly biasing mechanism is a spring.

4. An ignition lead assembly in accordance with claim 2 wherein said seal sub-assembly retainer is a snap ring.

5. An ignition lead assembly in accordance with claim 1 further comprising a coupling configured to connect said conduit non-air-cooled portion to said conduit air-cooled portion.

6. An ignition lead assembly in accordance with claim 5 wherein said coupling is between said seal sub-assembly and said conduit air-cooled portion.

7. An ignition lead assembly in accordance with claim 1 further comprising a first end, a second end, and a coupling, said conduit air-cooled portion extending between said first end and said coupling, said conduit non-air-cooled portion extending between said second end and said coupling, said coupling between said seal sub-assembly and said ignition lead assembly first end, and configured to connect said conduit non-air-cooled portion to said conduit air-cooled portion.

8. An ignition lead assembly in accordance with claim 7 wherein said conduit opening is radially outward from said seal sub-assembly, said ignition lead assembly first end configured to couple to an igniter, said ignition lead assembly second end configured to couple to an exciter.

9. A gas turbine engine comprising at least one pressurized ignition lead assembly configured to couple between an exciter and an igniter, said ignition lead assembly comprising a hollow conduit, an ignition cable, an engine coupling, and a seal sub-assembly, said conduit extending circumferentially around said ignition cable and comprising an air-cooled portion and a non-air-cooled, said seal sub-assembly between said ignition lead assembly air-cooled portion and said ignition lead assembly non-air-cooled portion, said seal sub-assembly comprising a housing and a seal therein, said engine coupling attached to said conduit non-air cooled portion for attaching said ignition cable to said gas turbine engine, said engine coupling comprising a seal configured to prevent pressure decreases of air from said engine coupling, said conduit further comprising an exterior surface, an interior surface, and an opening extending therebetween for supplying cooling air to said conduit air-cooled portion.

10. A gas turbine engine in accordance with claim 9 wherein said seal sub-assembly configured to prevent a loss of air pressure from said pressurized ignition lead assembly.

11. A gas turbine engine in accordance with claim 9 wherein said ignition lead assembly further comprises a first end, a coupling, and a second end, said coupling between said first end and said seal sub-assembly, said ignition lead assembly first end configured to couple to an igniter, said ignition lead assembly second end configured to couple to an exciter.

12. A gas turbine engine in accordance with claim 11 wherein said ignition lead assembly further comprises a port opening for supplying pressurized air to said conduit, said port opening between said seal sub-assembly and said ignition lead assembly second end.

13. A gas turbine engine in accordance with claim 9 wherein said ignition lead assembly seal sub-assembly further comprises a retainer and a biasing mechanism, said retainer configured to maintain said biasing mechanism within said seal sub-assembly housing.

14. A gas turbine engine in accordance with claim 13 wherein said ignition lead assembly seal sub-assembly retainer is a snap ring.

15. A gas turbine engine in accordance with claim 13 wherein said ignition lead assembly seal sub-assembly biasing mechanism is a spring.

16. A method for fabricating an ignition lead assembly, the ignition lead assembly including an ignition cable, a conduit including an air-cooled portion and a non-air-cooled portion, and a seal sub-assembly, said method comprising the steps of:

forming a seal sub-assembly including a housing and a seal therein, the seal sub-assembly configured to be inserted within the conduit non-air-cooled portion of the conduit;

providing a coupling to couple a first end of the conduit non-air-cooled portion to the conduit air-cooled portion, wherein the coupling includes an exterior surface, an interior surface, and an opening extending therebetween for supplying cooling air to the conduit air-cooled portion; and providing an engine coupling to couple a second end of the conduit non-air cooled portion to a gas turbine engine, wherein the engine coupling includes a seal to facilitate preventing decreases in pressure from air trapped within the engine coupling.

17. A method in accordance with claim 16 wherein said step of forming a seal sub-assembly further comprises the step of forming the seal sub-assembly housing to include a biasing mechanism and a retainer.

18. A method in accordance with claim 17 wherein said step of forming the seal sub-assembly housing further comprises the step of forming the retainer to maintain the biasing mechanism within the housing.

19. A method in accordance with claim 16 further comprising the step of forming a pressure port to connect to the non-air-cooled portion of the conduit.

* * * * *